US005077837A

United States Patent [19]

Meistrell

[11] Patent Number: 5,077,837

[45] Date of Patent: Jan. 7, 1992

[54] KNEE OR ELBOW PROTECTOR

[75] Inventor: William R. Meistrell, Manhattan Beach, Calif.

[73] Assignee: Dive N'Surf, Inc., Hermosa Beach, Calif.

[21] Appl. No.: 653,165

[22] Filed: Feb. 11, 1991

[51] Int. Cl.[5] ..... A41D 13/00

[52] U.S. Cl. ..... 2/16; 2/24; 2/22; 128/80 C; 128/165; 128/166; 128/155

[58] Field of Search ..... 2/24, 22, 16; 128/80 C, 128/165, 166, 153, 155

[56] References Cited

U.S. PATENT DOCUMENTS

| | | | |
|---|---|---|---|
| 2,552,177 | 5/1951 | Hurt | 2/24 |
| 3,990,440 | 11/1976 | Gaylord, Jr. | 2/24 |
| 4,116,236 | 9/1978 | Albert | 2/24 |
| 4,150,442 | 4/1979 | Boone | 2/24 |
| 4,474,573 | 10/1984 | Detty | 2/24 |
| 4,484,361 | 11/1984 | Leighton | 2/24 |
| 4,494,247 | 1/1985 | Kelly | 2/24 |
| 4,585,003 | 4/1986 | Meistrell | 128/402 |
| 4,599,747 | 7/1986 | Robinson | 2/24 |
| 4,700,406 | 10/1987 | Meistrell | 2/22 |
| 4,706,673 | 11/1987 | Meistrell | 128/402 |
| 4,796,303 | 1/1989 | Atwater | 2/24 |
| 4,805,620 | 2/1989 | Meistrell | 128/402 |
| 4,832,010 | 5/1989 | Lerman | 2/24 |
| 4,914,753 | 4/1990 | Chang | 2/24 |

*Primary Examiner*—Werner H. Schroeder
*Assistant Examiner*—Gloria Hale
*Attorney, Agent, or Firm*—William W. Haefliger

[57] ABSTRACT

A knee or elbow protector apparatus for application to an athlete's leg or arm, comprising a flexible, relatively thin wall tube that is bidirectionally stretchable, the tube having inner and outer sides, and opposite ends and sides to be stretched when slipped onto the leg or arm to cover the knee or elbow, the tube including a first elastomeric layer and a second layer of stretchable fabric attached to and substantially covering one side of the first layer; an elastomeric foam pad located adjacent the outer side of the tube and spaced from the opposite side; and retention fabric closely covering the pad and defining a loop-shaped peripheral portion that is attached to the tube.

11 Claims, 2 Drawing Sheets

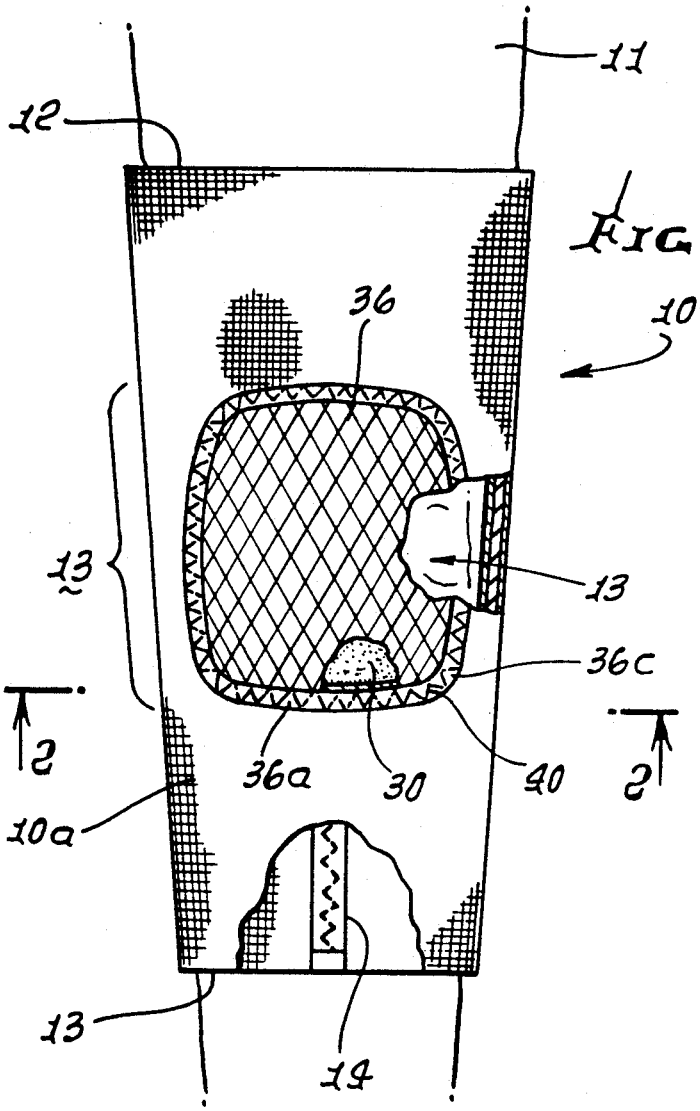
FIG. 1.
FIG. 1a.
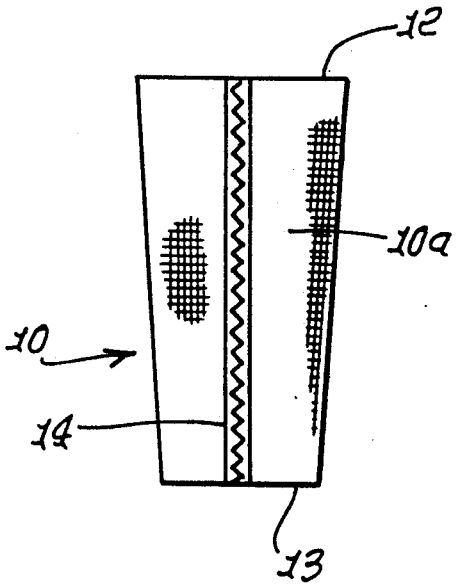

KNEE OR ELBOW PROTECTOR

BACKGROUND OF THE INVENTION

This invention relates generally to stretchable protectors applicable to the leg or arm of an athlete; and more particularly concerns a tubular device carrying a knee or elbow protector pad that easily attaches to and is retained in position on a leg or arm so as to locate and position the pad over the knee or elbow. It is especially useful for volleyball players' legs, to protect their knees. There is need for apparatus as disclosed and claimed herein.

SUMMARY OF THE INVENTION

It is a major object of the invention to provide apparatus meeting the above need, and which also provides unusual advantages in construction and modes of use, as respects accommodation to the athlete's leg or arm movement.

Basically, the device comprises:

a) a flexible, relatively thin wall tube that is bi-directionally stretchable, the tube having inner and outer sides, and opposite ends, to be stretched when slipped onto the leg or ar to cover the knee or elbow, the tube including a first elastomeric layer and a second layer of stretchable fabric attached to and substantially covering one side of the first layer, b) an elastomeric foam pad located adjacent the outer side of the tube and spaced from the opposite side, c) and retention fabric closely covering the pad and defining a loop-shaped peripheral portion that is attached to the tube.

As will appear, the protector apparatus preferably has such stretchability as to be in at least partly stretched condition in use, while conforming to protected positioning of the pad or cushion on the user's limb, allowing the user to walk about or to flex his knee, with his limb resiliently compressively guarded and covered.

It is a further object of the invention to provide an improved device of the above character, wherein the thin, elongated tube comprises an insulative, flexible, stretchable layer of material, such as elastomer, foamed rubber being usable, and protective stretchable fabric covering at least one side of the elastomer layer, and preferably both sides, allowing for comfortable engagement against the wearer's skin, and also smooth sliding contact with exterior objects.

It is a further object of the invention to provide apparatus affording double cushioning at the knee or elbow, as for example not only by the pad, which may be dome shaped, but also by the material of the tube wall underlying the pad and directly covering the knee or elbow, a pad hollow interposed between the pad and the wall.

These and other objects and advantages of the invention, as well as the details of an illustrative embodiment, will be more fully understood from the following specification and drawings, in which:

DRAWING DESCRIPTION

FIG. 1 is a frontal view of a player's knee guard employing a retention tube;

FIG. 1*a* is a rear view of the guard of FIG. 1;

DETAILED DESCRIPTION

Figure 2:
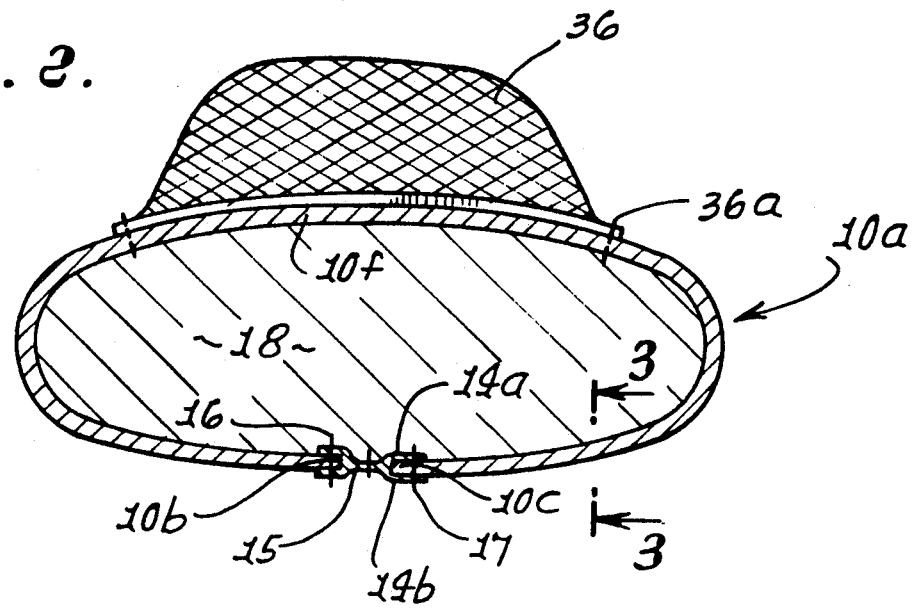
FIG. 2 is a section taken on lines 2—2 of FIG. 1.

In the drawings, a tube 10 defines a wall 10*a* adapted to compressively wrap about a user's leg or arm 11, as by endwise fitting thereon. The tube has opposite ends 12 and 13, and in applied condition fits closely to the limb, as indicated by the taper seen in FIG. 1, conforming to user's leg taper above and below the knee area indicated at 13. The tube wall is continuous, except at the rear, a vertical seam 14 being provided by two elongated, stretchable, thin bands 14*a* and 14*b* attached together at 15, (as by stitching) in superimposed relation, and also stitched at 16 and 17 to elongated edge portions 10*b* and 10*c* of the wall. The limb protected cross-section appears at 18 in FIG. 2.

Figure 3:
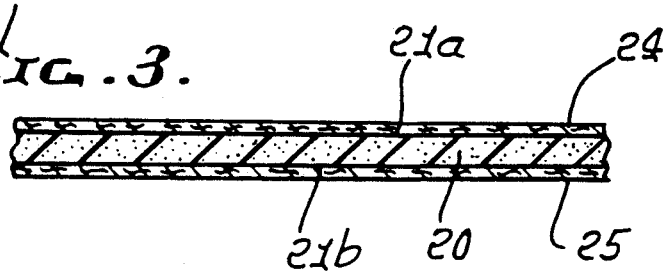
FIG. 3 is an enlarged fragmentary section taken on lines 3—3 of FIG. 2 and the wall construction.

The tube wall 10*a* includes a first elastomeric layer 20 of uniform thickness, and a second and substantially thinner layer of stretchable, plush fabric attached to (as by bonding) and substantially covering one side of the layer 20. Preferably, a third layer of such fabric is provided and is attached to and substantially covers the opposite side of layer 20 See for example the two fabric layers 24 and 25 in FIG. 3 bonded to layers 20 at 21*a* and 21*b*.

The underlayer 20 consists of an elastomer, such as foamed rubber (NEOPRENE), of a thickness between about 1/32 and 5/16 inch. The fabric or layers 24 and 25 may be formed from the commercial product known as N-2 3 mm NEOPRENE. Further, layer 20 (and also one or both layers 24 and 25) are resiliently compressible to afford cushioning protection to the entire portion of the limb so covered, especially the knee or elbow.

Also provided is an elastomeric foam pad 30 located at or adjacent the outer side of the tube 10, and spaced from the opposite tube ends 12 and 13. The pad may for example consist of foam rubber; and it has outer and inner sides 31 and 32, the inner side facing the tube wall portion 10*f* directly underlying or registered with the pad. Accordingly, double cushioning is provided. Pad inner side 32 defines a shallow hollow 34 interposed between the inner wall or side 32 and the tube wall portion 10*f*, whereby the user's knee or elbow may deflect the wall portion 10*f* into that hollow as the knee or elbow flexes without compressing the pad material; that is, thinning of the protective pad as a result of limited knee or elbow flexing is avoided, and continuous ultimate protection from external impacts against the pad is achieved, irrespective of the flexed (at least initially flexed) condition of the knee or elbow.

This effect is enhanced by the essentially non-stretchable connection of the loop-shaped attachment at 36*a* (as via seam binding material) of pad retention fabric 36 to the tube wall, whereby stretching and thinning of the pad itself during knee or elbow flexing is minimal. Thin fabric 36 covers the dome shaped outer side 31 of the pad 30 and is brought down at 36*b* toward the wall of the tube, adjacent the pad wall. The fabric loop-shaped, flat, peripheral portion 36*c* is attached, as by zig-zag stitching at 40 to the tube wall, thereby to positively position the pad as described. The loop-shaped, peripheral portion 36*c* may have a cross dimension D between 3 and 5 inches, so as to encompass the knee or elbow so protected. It is retained in position in use, as during vigorous flexing of the knee, due to the bidirectional resilient stretchability of the tube wall outside the loop 36c, in applied position, as described, while tube wall portion 10f is resiliently deflectible by the knee, in arrow direction 42.

Hollow 34 has increasing depth, towards the central axis 43 of the pad, maximum depth at that axis being between ½ and 1 inches, thereby conforming to knee or elbow convexity as the knee or elbow flexes to deform the tube wall portion 10f into the hollow.

Figure 4:
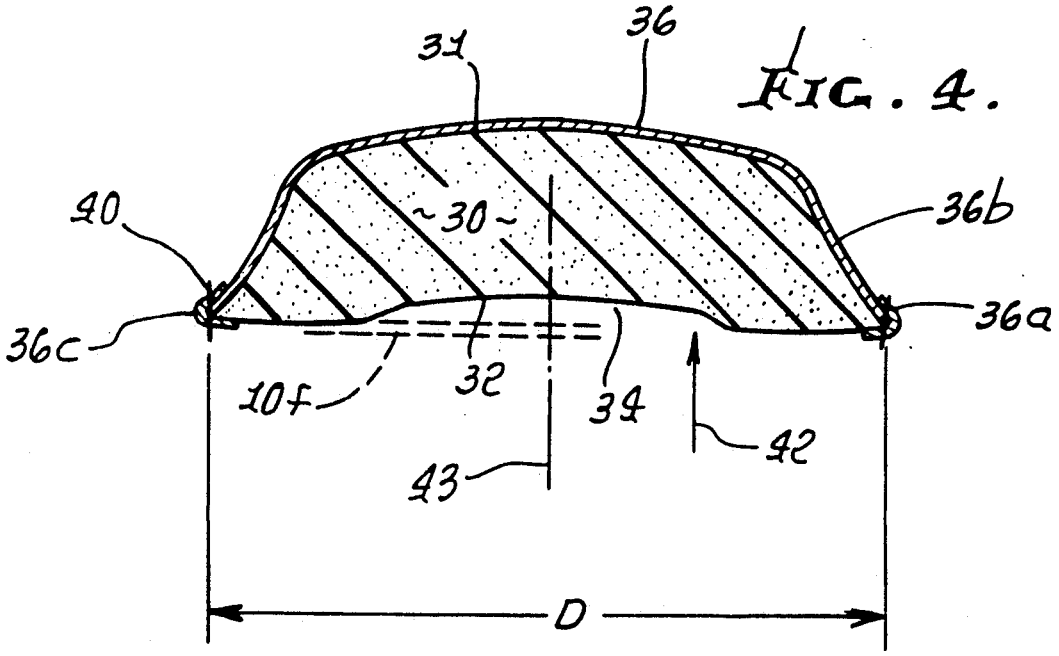
FIG. 4 is an enlarged cross section taken showing pad configuration and construction in relation to retention fabric.

Note in FIG. 4 the stitching at 40 of the fabric 36 to the pad periphery prior to attachment at 36a to the tube wall, firm anchoring of the pad thereby being provided.

I claim:

1. A knee or elbow protector apparatus for application to an athlete's leg or arm, comprising, in combination:

a) a flexible, relatively thin walled tube that is bi-directionally stretchable, the tube having inner and outer sides, and opposite ends, and sized to be stretched when slipped onto the leg or arm to cover the knee or elbow, the tube including a first elastomeric layer and a second layer of stretchable fabric attached to and substantially covering one side of the first layer, b) an elastomeric foam pad located adjacent the outer side of said tube and spaced from said opposite ends, c) and retention fabric closely covering the pad and defining a loop-shaped, peripheral portion that is attached to said tube.

2. The combination of claim 1 wherein said first layer comprises foam rubber.

3. The combination of claim 1 wherein the tube includes a third layer of stretchable fabric attached to said first layer.

4. The combination of claim 2 wherein said pad has an outer and inner side, the pad inner side facing said tube.

5. The combination of claim 4 wherein the pad inner side defines a hollow adjacent said tube, the said pad outer side having a dome shape.

6. The combination of claim 4 wherein the pad inner side defines a peripheral portion located adjacent said tube, the pad inner side also defining a medial hollow adjacent said tube.

7. The combination of claim 6 wherein said retention fabric lies adjacent said pad.

8. The combination of claim 2 including stitching attaching said loop-shaped portion of the retention fabric to said tube.

9. The combination of claim 2 wherein said second layer consists of an elastomer.

10. The combination of claim 5 wherein the tube wall extends in direct registration with the pad and said hollow.

11. The combination of claim 8 wherein the tube has a bi-directionally stretchable wall portion covering said hollow and deflectible into the hollow by the knee, during knee flexing, that wall portion isolated from the remainder of the tube wall by said stitching of the loop-shaped portion of the retention fabric to said tube.

* * * * *